US005765321A

United States Patent [19]

Barbera

[11] Patent Number: 5,765,321

[45] Date of Patent: Jun. 16, 1998

[54] GROUND ENGAGING STAKE

[75] Inventor: James S. Barbera, Canton, Ohio

[73] Assignee: Barbco, Inc., Canton, Ohio

[21] Appl. No.: 801,944

[22] Filed: Feb. 14, 1997

[51] Int. Cl.[6] ..... G02D 5/74

[52] U.S. Cl. ..... 52/155; 405/244

[58] Field of Search ..... 52/155, 158, 159, 52/160, 162, 163, 164; 248/85, 87, 156, 545; 405/244, 233

[56] References Cited

U.S. PATENT DOCUMENTS

| | | |
|---|---|---|
| 826,908 | 7/1906 | Thomas . |
| 2,176,566 | 10/1939 | Dillon . |
| 3,332,183 | 7/1967 | Ondrejka . |
| 3,526,069 | 9/1970 | Deike . |
| 4,086,735 | 5/1978 | Adams . |
| 5,010,698 | 4/1991 | Hugron . |

FOREIGN PATENT DOCUMENTS 2479303 10/1981 France ..... 405/244

*Primary Examiner*—Creighton Smith
*Attorney, Agent, or Firm*—Sand & Sebolt

[57] ABSTRACT

A ground engaging stake used to anchor and support equipment with respect to the soil includes an I-beam and a spring assembly which engages the I-beam. The I-beam includes a web plate and a pair of end plates which extend perpendicularly to the web plate at opposite edges thereof. A pair of guide plates are spaced from and parallel to a middle portion of the web plate. A pair of cams are mounted on each side of the web plate adjacent a bottom end thereof. The spring assembly includes a pair of spaced parallel springs rigidly attached to one another at a top thereof by a center stop. A pair of side stop blocks are attached to the top outer surface of each spring. Springs 32 extend between a slot formed between the guide plates and web plate of the I-beam. The spring is driven downwardly causing the springs to deflect against an angled top surface of each cam and bend slightly outwardly away from the I-beam. The lateral projection of each spring creates a resistance against the soil to retain the ground stake in a stationary position with respect to the soil.

17 Claims, 4 Drawing Sheets

GROUND ENGAGING STAKE

BACKGROUND OF THE INVENTION

1. Technical Field

Generally, the invention relates to a ground engaging stake. Particularly, the invention relates to a ground engaging stake which extends into the ground for anchoring and supporting equipment with respect to the soil. Specifically, the invention relates to a ground engaging stake having a pair of movable springs which deflect laterally outwardly adjacent to a bottom of the stake to retain the stake in a stationary position with respect to the soil.

2. Background Information

Ground engaging stakes are commonly used to anchor and support heavy equipment, such as earth boring machines, in a stationary position with respect to the soil. Typically, these stakes include a hollow post which is inserted into the ground and a pair of flexible projections which extend within an interior of the post and which deflect laterally outwardly into the soil in an upward hook-shaped arcuate path. These projections provide a resistance within the ground which prevents the post from being pulled from its engagement with the soil.

One problem with these stakes is that the arcuate path through which the projections travel make it difficult to pull the projections up through the post when the post is to be removed from the ground and subsequently reused. Further, the projections must be formed of a relatively flexible material which allows the projections to extend straight through the interior of the post then bend through the arcuate path to anchor the stake with respect to the soil.

An example of this type of ground engaging stake is shown in U.S. Pat. No. 326,908 which discloses an anchor for airships having a rectangular-shaped body and two prongs pivotally connected to a rod. The rod is forced downwardly as the body is driven into the soil causing the prongs to pivot outwardly in an arcuate path into the soil to secure the anchor with respect to the soil.

U.S. Pat. No. 2,176,566 discloses an anchor having a plurality of blades pivotally attached to a head. The blades deflect outwardly in an arcuate path as the head is forced downward into the soil.

U.S. Pat. No. 3,332,183 discloses a recoverable ground anchor having a metal rod with a plurality of hinged toggle members which are urged outwardly producing a large bearing area to retain the anchor with respect to the soil.

U.S. Pat. No. 3,526,069 discloses an anchoring device having a pair hooks attached to a single bar positioned within a body of the anchoring device. The bottom of the hooks communicate with a pair of camming surfaces with each camming surface urging one of the hooks outwardly in an arcuate path through a slot formed in the bottom of the anchoring device. When force is applied downwardly on the device, the hooks are forced out of the slots via the interaction with the camming surfaces causing the hooks to rotate upwardly in an arcuate path to engage the ground adjacent the anchor body.

U.S. Pat. No. 4,086,735 discloses a soil anchor having a square drive tube and two anchor straps which are driven downwardly through the tube and past curved guides in the bottom of the tube causing the anchor straps to bend outwardly through slots formed in the square drive tube, and into the soil adjacent the drive tube.

U.S. Pat. No. 5,010,698 discloses an anchoring post assembly having a hollow tube and two laterally slanted channels formed within the tube adjacent the bottom end thereof. A bifurcated element having two prongs is adapted to be pushed downwardly within the tube and through the channels until the prongs project outwardly in an arcuate path and into the soil for retaining the tube in the ground.

Although these prior art ground engaging stakes are adequate for the purpose for which they were intended, the upward arcuate path and the relatively far distance which the projections of these prior devices travel make the ground engaging stakes difficult to pull out of the ground for subsequent reuse. Also, the projections of these prior art ground engaging stakes must be formed from a very flexible material which allows the projections to bend in the upward arcuate path. This flexible material may allow the projections to flex back to a straight position when an upward pressure is applied thereto by the equipment being anchored by these prior art ground engaging stakes possibly pulling the prior art stakes from their engagement with the soil.

Additionally, prior art staking devices while presumably adequate for the purpose for which they are intended, may be difficult to manufacture and do not utilize readily available preformed steel elements thereby substantially increasing manufacturing costs.

Therefore, the need exists for a ground engaging stake which has springs which extend only a short distance from the center post, which springs bend only slightly from the center post and which is easily removed from the ground. The need also exists for a ground engaging stake which utilizes readily available preformed steel cross-sectional configurations to substantially reduce manufacturing costs.

SUMMARY OF THE INVENTION

Objectives of the invention include providing an improved ground engaging stake which extends into the ground for anchoring and supporting equipment with respect to the soil.

A further objective is to provide a ground engaging stake in which springs extend into the soil a short distance from a center post of the stake to anchor the stake within the ground.

Another objective is to provide a ground engaging stake in which the springs bend only slightly outwardly away from the center post.

A still further objective is to provide a ground engaging stake which is easily removed from the engagement with the ground for subsequent reuse.

Yet another objective is to provide a ground engaging stake which utilizes a commonly formed I-beam as the base body structure.

Still another objective is to provide a ground engaging stake which may be easily removed from the ground by simply attaching a chain through holes formed in the top thereof.

A further objective is to provide a ground engaging stake which is of simple construction which achieves the stated objectives in a simple, effective and inexpensive manner, which solves problems and satisfies needs existing in the art.

These objectives and advantages are obtained by the ground engaging stake of the present invention the general nature of which may be stated as including a ground engaging stake adapted to anchor objects with respect to the soil, said stake comprising: a center beam having an elongated web plate with a top end, a bottom end, a pair of opposed edges, a pair of opposed flat outer surfaces, and a pair of elongated end plates extending perpendicular to the web plate and attached to the opposed edges thereof; a pair of cams mounted on the flat outer surfaces of the web plate adjacent the bottom end thereof; and a pair of springs slidably engaging the center beam which deflect outwardly against the cams.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
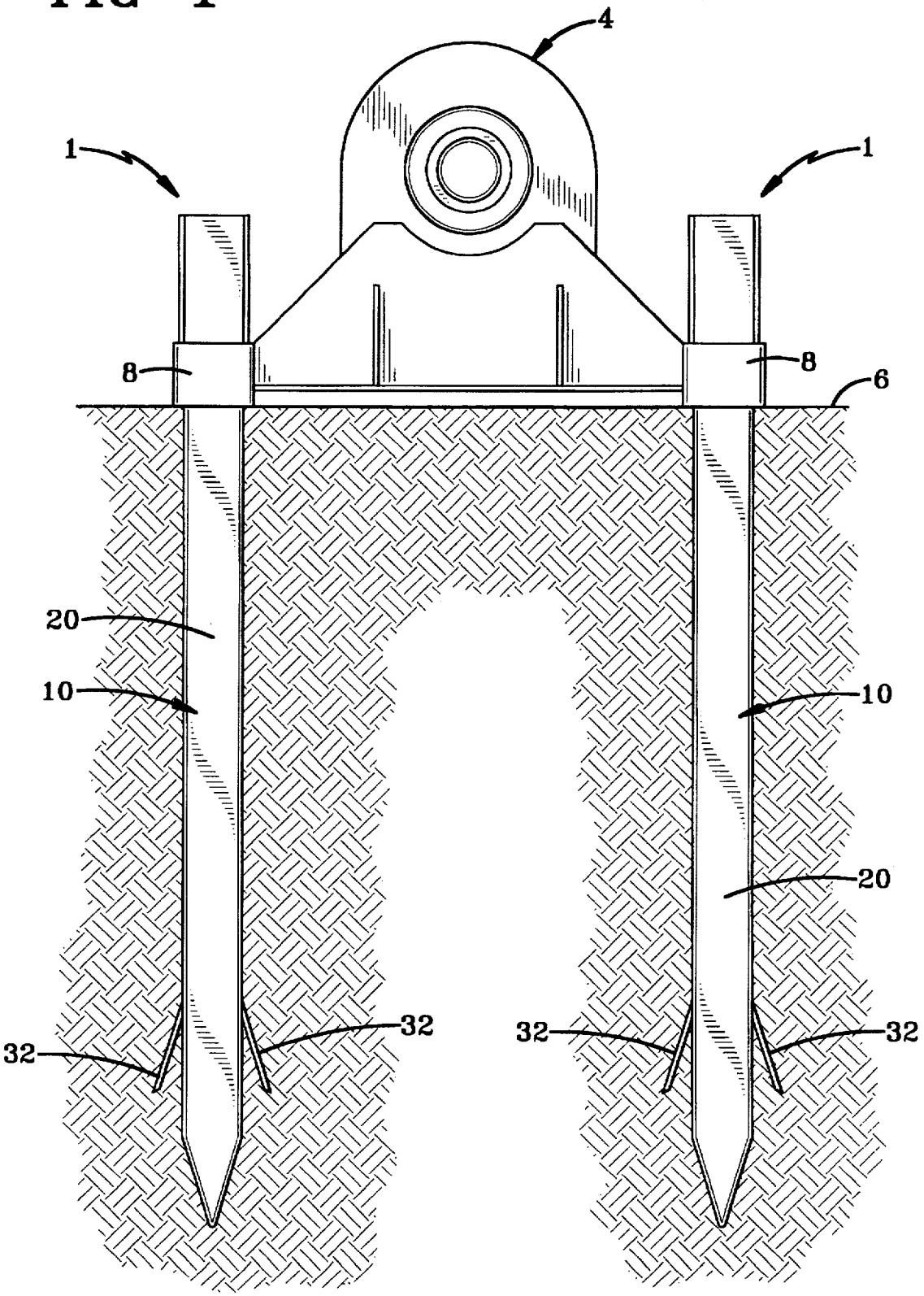
FIG. 1 is an elevational view showing a pair of the ground engaging stakes of the present invention anchoring and supporting an earth boring machine with respect to the soil.
Figure 2:
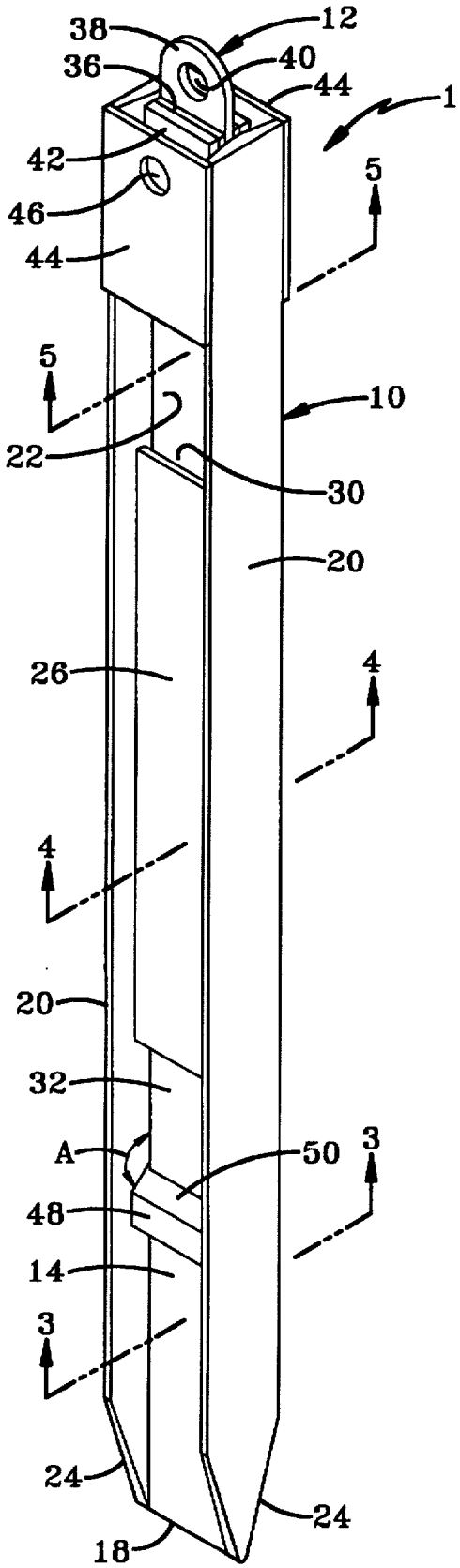
FIG. 2 is a perspective view of one of the ground engaging stakes of FIG. 1.
Figure 3:
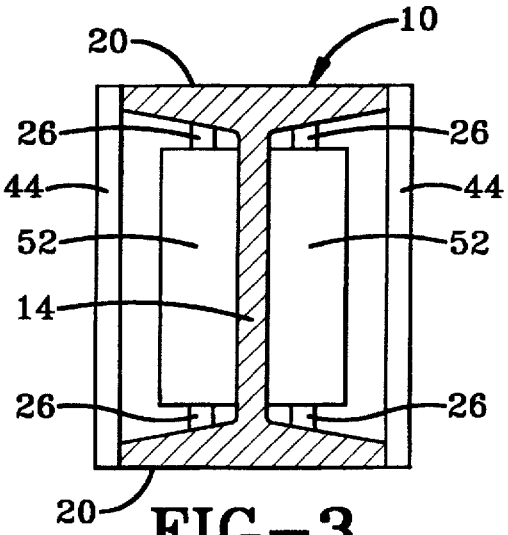
FIG. 3 is a sectional view taken along line 3—3, FIG. 2.

A pair of ground engaging stakes of the present invention are indicated generally at 1 in FIG. 1 and are shown anchoring and supporting an earth boring machine 4 with respect to soil 6. Earth boring machine 4 includes a pair of sleeves 8 which extend around ground engaging stakes 1 to retain earth boring machine 4 in a stationary position. Ground engaging stakes 1 each include a body 9. In accordance with one of the main features of the present invention, body 9 is formed from an I-beam 10 (FIGS. 2–4) and is sized to receive a spring assembly 12. I-beam 10 includes an elongated web plate 14 having top and bottom ends 16 (FIGS. 6 and 7) and 18, respectively, and a pair of spaced parallel end plates 20 formed integrally with opposed edges of web plate 14.

Figure 6:
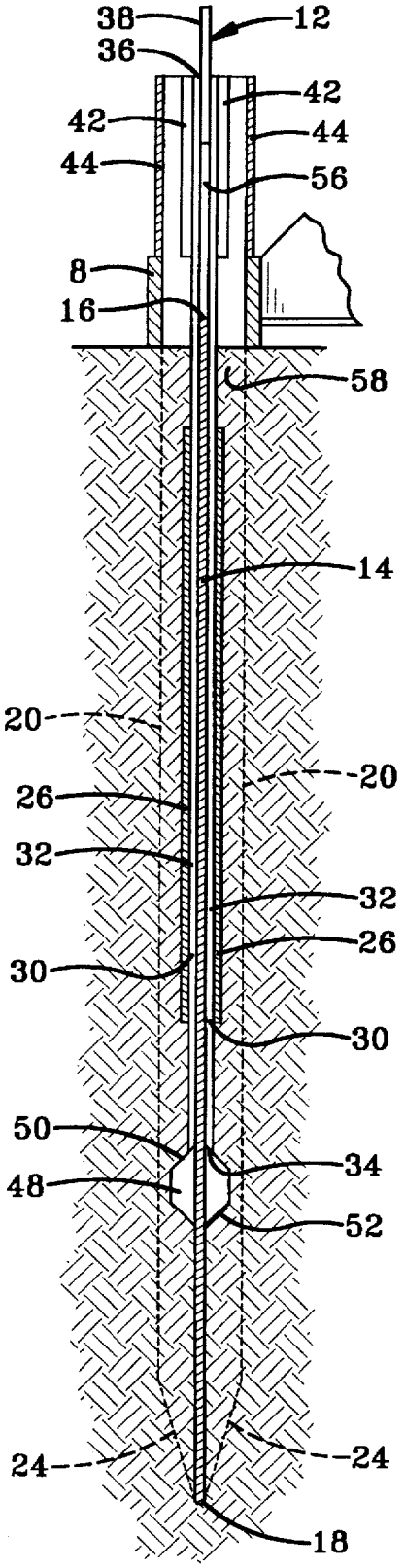
FIG. 6 is a sectional view of the ground engaging stake of FIG. 2.
Figure 7:
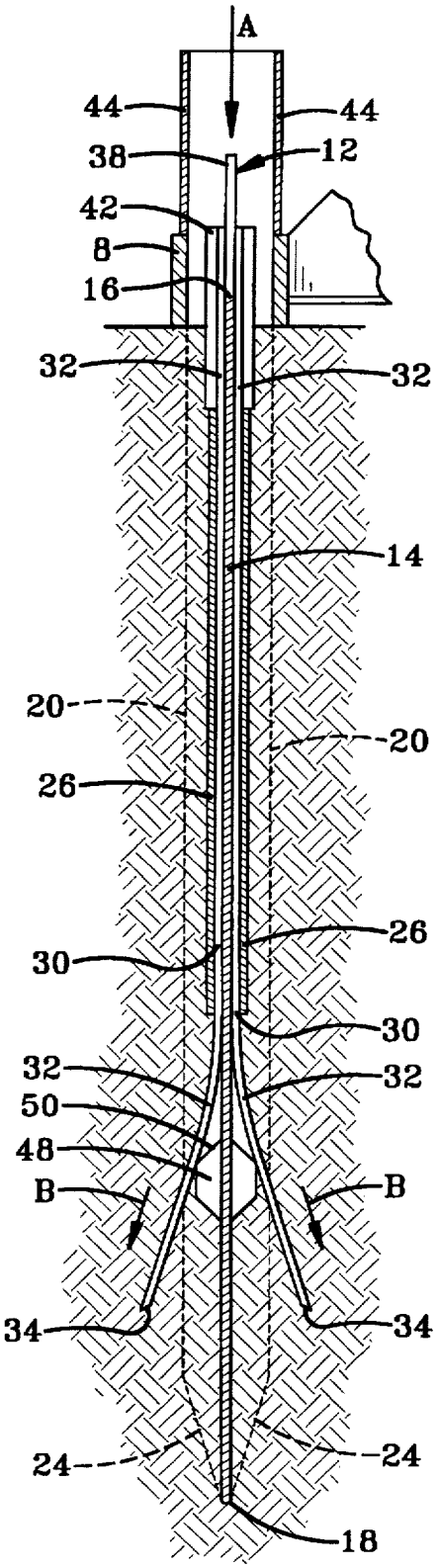
FIG. 7 is a sectional view similar to FIG. 6 showing the springs of the ground engaging stake in an outwardly extending position.

End plates 20 are perpendicular to and extend to a height greater than that of web plate 14 (FIGS. 6 and 7). End plates 20 form central apertures 22 on each side of web plate 14 and are tapered at the bottom thereof to form a pointed bottom end 24 of I-beam 10.

Figure 4:
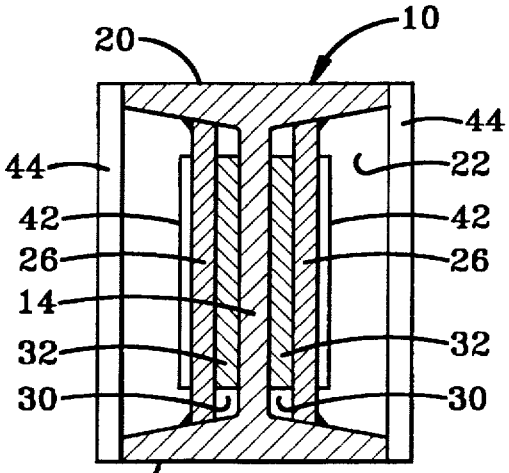
FIG. 4 is a sectional view taken along line 4—4, FIG. 2.
Figure 5:
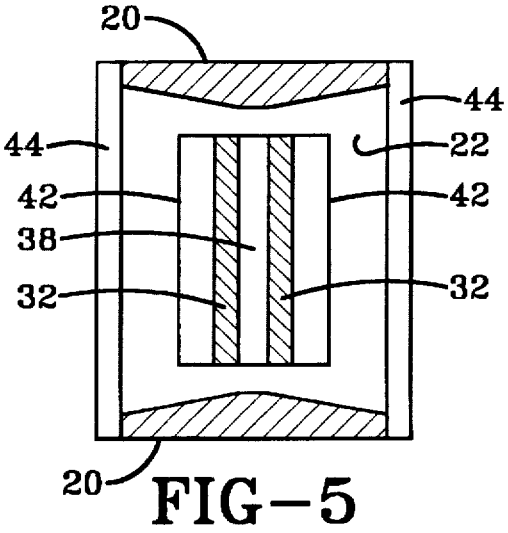
FIG. 5 is a sectional view taken along line 5—5, FIG. 2.

A guide plate 26 is positioned on each side of web plate 14 within the respective aperture 22 and is spaced from and parallel to web plate 14. Guide plates 26 extend between end plates 20 of I-beam 10 and are permanently welded thereto by welds 28 (FIG. 4). Guide plates 26 are substantially shorter than web plate 14 and extend adjacent a middle portion thereof forming a slotted opening 30 with web plate 14 and end plates 20.

In accordance with another of the features of the invention, spring assembly 12 includes a pair of springs 32 which are slidably inserted within apertures 22 between web plate 14 and guide plates 26 for anchoring ground engaging stake 1 within soil 6. Springs 32 include an angled bottom end 34 (FIGS. 6 and 7) and are connected together at a top end 36 thereof by a center stop 38. Center stop 38 includes a lug-shaped eyelet 40 (FIG. 2) which is used to remove springs 32 from their engagement with soil 6, as described below in further detail. Springs 32 extend adjacent to the outer surfaces of web plate 14 forming a gap 56 between top end 16 of web plate 14 and the bottom end of center stop 38. A second gap 58 is formed between the top end of guide plates 26 and the bottom end of side stop blocks 42 which is substantially equally to the length of gap 56. Alternatively, center stop 38 extending between springs 32 may be removed such that springs 32 may be independently driven into soil 6 and removed therefrom via a hole (not shown) formed in the top of each spring 32.

A side stop block 42 is attached to the top outer surface of each spring 32 to limit the vertical travel of spring 32, as described below. A top eye-plate 44 is attached between the outer edges of opposed end plates 20 and extends from the top end of ground engaging stake 1 downwardly a relatively short distance. Each eye-plate 44 has a hole 46 formed therein for removing ground engaging stakes 1 from soil 6.

In accordance with another feature of the invention, a pair of cams 48 which have angled top and bottom surfaces 50 and 52, respectively, are mounted on opposed outer surfaces of web plate 14 adjacent a bottom thereof. In the preferred embodiment, top and bottom surfaces 50 and 52 of each cam 48 extend at an angle of approximately 45° forming an angle "A" of approximately 135° with the center surfaces of web plate 14.

In use, spring assembly 12 engages I-beam 10 whereby springs 32 are slidably inserted within slotted openings 30 between guide plates 26 and web plate 14 until angled bottom end 34 of springs 32 abuts angled top surface 50 of cams 48. Ground engaging stake 1 is inserted through sleeve 8 of earth boring machine 4 and is driven into soil 6 until eye-plates 44 of ground engaging stake 1 abut the top end of sleeves 8 (FIG. 6) restricting any further downward movement of stake 1. Spring assembly 12 is then driven in the direction of arrow A (FIG. 7) by a pneumatic hammer, for example. The downward movement of spring assembly 12 causes angled bottom ends 34 of springs 32 to deflect angularly outwardly against angled top surfaces 50 of cams 48 in the direction of arrows B. Spring assembly 12 is driven in the direction of arrow A until center stop 38 abuts top end 16 of web plate 14 and stop blocks 42 abut the top end of guide plates 26 preventing any further downward movement of spring assembly 12. The connection between center stop 38 and side stop blocks 42 with springs 32 causes springs 32 to stop moving in the direction of arrow B when the vertical movement of center stop 38 and stop blocks 42 is stopped by web plate 14 and guide plates 26, respectively. When spring assembly 12 is in the anchoring position of FIG. 7, the lower portion of springs 32 are bent outwardly by the interaction between cams 48 and guide plates 26. Springs 32 extend laterally away from I-beam 10 to retain ground engaging stake 1 in a stationary position with respect to soil 6. Springs 32 apply a lateral outward pressure away from ground engaging stake 1 and trap a quantity of soil 6 between I-beam 10 and the ends of springs 32. Soil 6 applies a downward resistance to the outer surface of springs 32 increasing the holding pressure of ground engaging stake 1 from 200 percent to 300 percent.

Figure 8:
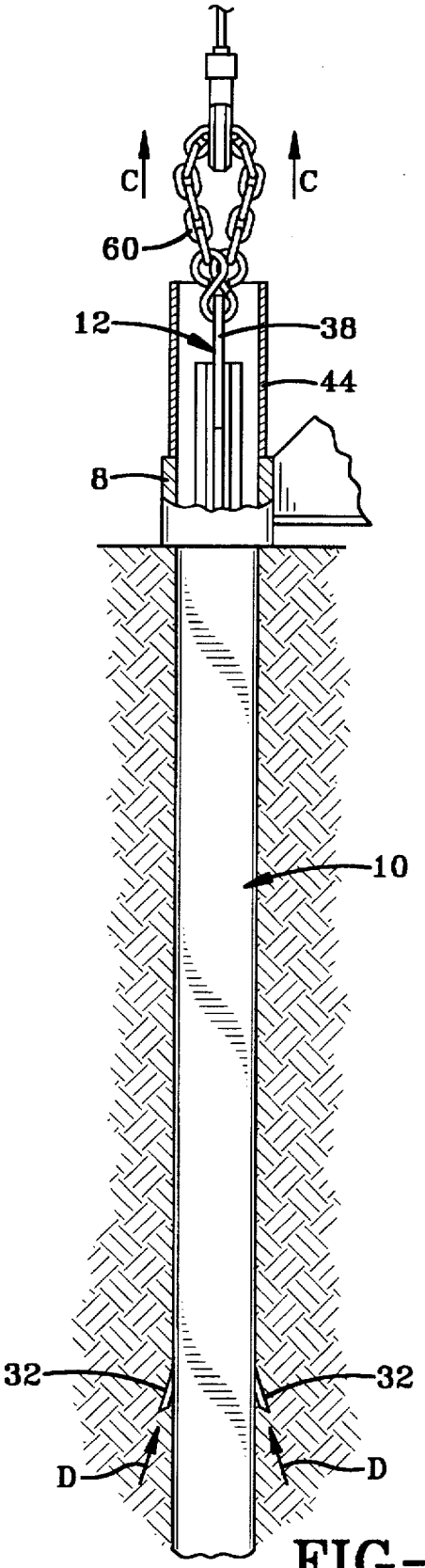
FIG. 8 is an elevational view with a portion broken away showing the springs being withdrawn from the extended position of FIG. 7.
Figure 9:
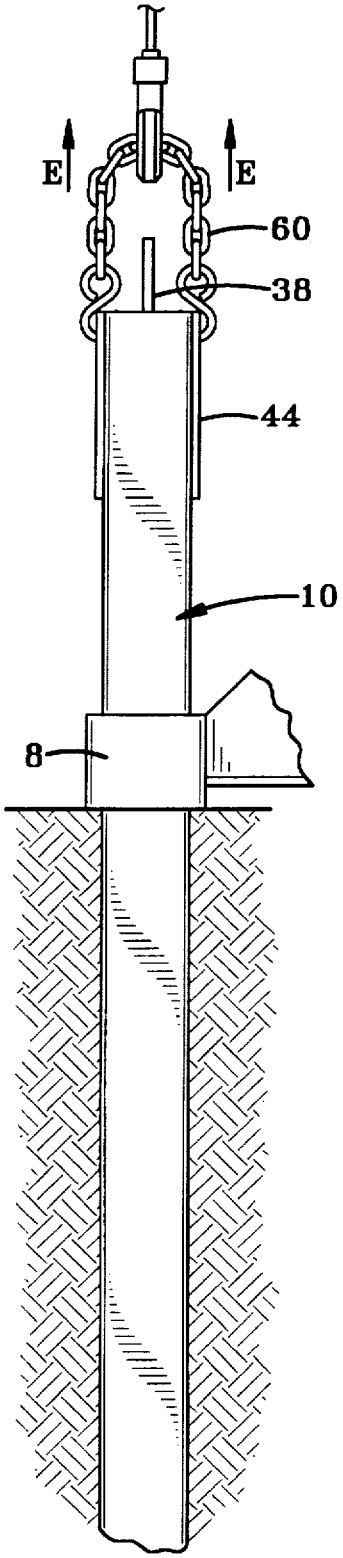
FIG. 9 is elevational view similar to FIG. 8 showing the ground engaging stake being removed from its engagement with the soil.

After use, ground engaging stake 1 is removed from soil 6 by connecting a chain 60 through eyelet 40 of center stop 38 and applying an upward pressure in the direction of arrows C (FIG. 8). Springs 32 are retracted back into apertures 22 in the direction of arrows D as spring assembly 12 is pulled upwardly. Once springs 32 have returned to their original position adjacent web plate 14 and above cams 48, chain 60 is then connected between holes 46 of I-plates 44 (FIG. 9) and an upward pressure is applied to I-beam 10 in the direction of arrows B pulling ground engaging stake I from its engagement with soil 6. Ground engaging stake 1 is lifted until pointed bottom end 24 of I-beam 10 clears the top end of sleeves 8 of earth boring machine 4 releasing earth boring machine 4 from its anchored positioned.

In the preferred embodiment, springs 32 are formed of steel and are of a sufficient thickness to allow the lower portion thereof to deflect slightly outwardly in the bent position of FIG. 7. The slight outward extension of springs 32 away from I-beam 10 allow spring assembly 12 to be easily retracted to its stored position adjacent web plate 14. Eyelet 40 and I-plates 44 allow ground engaging stake 1 to be easily pulled from its anchored position within soil 6 to be reused. Because springs 32 need only bend a slight amount, ground engaging stake 1 and particularly springs 32 are preferably of a thick heavy-duty construction which allows ground engaging stake 1 to be reused indefinitely.

Accordingly, spring assembly 12 slidably engages I-beam 10 whereby springs 32 extend between guide plates 26 and web plate 14. Angled bottom ends 34 of springs 32 cam against angled top surface 50 of cams 48 and deflect laterally away from I-beam 10 to prevent ground engaging stake 1 from being pulled from soil 6. Eye-plates 44 abut sleeves 8 of earth boring machine 4 preventing any upward movement of sleeves 8 and retain earth boring machine 4 in a stationary position. Gap 56 formed between center stop 38 and top end 16 of web plate 14 is the same length as gap 58 formed between stop blocks 42 and guide plates 26 causing center stop 38 and stop blocks 42 to cooperate in stopping the downward vertical movement of spring assembly 12. The lower portion of springs 32 are bent outwardly by cams 48 while the middle portion is held adjacent web plate 14 by guide plates 26 causing the lateral bending of springs 32. Springs 32 are easily retracted by applying an upward pressure on center stop 38 until springs 32 return to their position adjacent web plate 14 slightly above cams 48. Holes 46 of eye-plates 44 allow ground engaging stake 1 to be easily removed from soil 6 releasing the equipment held thereby.

Accordingly, the improved ground engaging stake is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved ground engaging stake is constructed and used, the characteristics of the construction, and the advantageous, new and useful results obtained; the new and useful structures, devices, elements, arrangements, parts and combinations, are set forth in the appended claims.

I claim:

1. A ground engaging stake adapted to anchor objects with respect to the soil, said stake comprising:

a center beam having an elongated web plate with a top end, a bottom end, a pair of opposed edges, a pair of opposed flat outer surfaces, and a pair of elongated end plates extending perpendicular to the web plate and attached to the opposed edges thereof;

a pair of springs having a pair of flat inner surfaces adjacent the flat outer surfaces of the center beam and a pair of outer surfaces opposed thereto slidably engaging the center beam which deflect outwardly against the cams; and a pair of guide plates extending between the end plates spaced from and parallel to the flat outer surfaces of the web plate, said guide plates having a top end and a bottom end.

2. the stake defined in claim 1 in which one guide plate extends on each side of the web plate.

3. The stake defined in claim 2 further including a slot formed between each guide plate and the web plate.

4. The stake defined in claim 3 in which each spring is positioned within a respective slot and is slidable therein.

5. The stake defined in claim 4 in which each cam includes an angled top surface.

6. The stake defined in claim 5 in which the top surface of each cam is angled at approximately 45 degrees.

7. The stake defined in claim 5 in which the end plates have a length greater than a length of the web plate.

8. The stake defined in claim 5 further including a center stop block attached between the springs at a top end of the springs, said center stop block being aligned with the web plate.

9. The stake defined in claim 5 further including a pair of side stop blocks attached to the outer surfaces of the springs, said side stop blocks having a top end and a bottom end.

10. The stake defined in claim 9 in which the side stop blocks are co-linear with the guide plates such that the side stop blocks contact the guide plate when the springs are in a lowered position.

11. The stake defined in claim 10 in which a first gap is formed between the top end of the web plate and a bottom end of the center stop block.

12. The stake defined in claim 10 in which a second gap is formed between the bottom end of the side stop blocks and the top end of the guide plates; and in which the first gap has a length substantially equal to a length of the second gap.

13. The stake defined in claim 12 in which a hole is formed in the center stop.

14. The stake defined in claim 13 further including an eye-plate extending between the end plates and positioned on each side of the web plate adjacent to the top end thereof.

15. The stake defined in claim 14 in which a hole is formed in each eye-plate.

16. The stake defined in claim 15 in which the beam has an angled bottom end.

17. The stake defined in claim 15 in which the beam and spring assembly are formed of steel.

* * * * *